US010320053B2

(12) United States Patent
Song et al.

(10) Patent No.: US 10,320,053 B2
(45) Date of Patent: Jun. 11, 2019

(54) WIDEBAND COPLANAR WAVEGUIDE FED MONOPOLE APPLIQUE ANTENNAS

(71) Applicant: GM GLOBAL TECHNOLOGY OPERATIONS LLC, Detroit, MI (US)

(72) Inventors: Hyok Jae Song, Oak Park, CA (US); Timothy J. Talty, Beverly Hills, MI (US); James H. Schaffner, Chatsworth, CA (US); Keerti S. Kona, Woodland Hills, CA (US); Amit M. Patel, Santa Monica, CA (US); Duane S. Carper, Davison, MI (US); Eray Yasan, Canton, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 156 days.

(21) Appl. No.: 15/415,483

(22) Filed: Jan. 25, 2017

(65) Prior Publication Data

US 2017/0237147 A1 Aug. 17, 2017

Related U.S. Application Data

(60) Provisional application No. 62/295,822, filed on Feb. 16, 2016.

(51) Int. Cl.

| | |
|---|---|
| ***H01Q 1/48*** | (2006.01) |
| ***H01Q 1/12*** | (2006.01) |
| ***H01Q 1/32*** | (2006.01) |
| ***H01Q 21/00*** | (2006.01) |
| ***H01Q 1/38*** | (2006.01) |
| ***H01Q 9/42*** | (2006.01) |

(52) U.S. Cl.

CPC ..... *H01Q 1/1271* (2013.01); *H01Q 1/325* (2013.01); *H01Q 1/38* (2013.01); *H01Q 1/48* (2013.01); *H01Q 9/42* (2013.01); *H01Q 21/0037* (2013.01)

(58) Field of Classification Search

CPC ..... H01Q 1/1271; H01Q 1/325; H01Q 1/32; H01Q 9/42; H01Q 1/38; H01Q 1/48; H01Q 21/0037

USPC ..... 343/713

See application file for complete search history.

(56) References Cited

U.S. PATENT DOCUMENTS

| | | | | |
|---|---|---|---|---|
| 7,427,961 | B2 * | 9/2008 | Song | H01Q 1/1271 343/711 |
| 2003/0112190 | A1 * | 6/2003 | Baliarda | H01Q 1/1271 343/713 |
| 2007/0040756 | A1 * | 2/2007 | Song | H01Q 1/1271 343/713 |

(Continued)

OTHER PUBLICATIONS

Augustin G. et al. "Coplanar Waveguide-Fed Uniplanar Trapezoidal Antenna With Linear and Circular Polarization" IEEE Transactions on Antennas and Propagation, vol. 60, No. 5, May 2012, pp. 2522-2526.

(Continued)

*Primary Examiner* — Hai V Tran

(74) *Attorney, Agent, or Firm* — Cantor Colburn LLP

(57) ABSTRACT

A thin, flexible antenna that has particular application to be mounted to a dielectric structure on a vehicle, such as vehicle glass, where the antenna has a wideband antenna geometry for various communications applications, and where the conductive portion of the antenna can employ transparent conductors.

17 Claims, 3 Drawing Sheets

(56) References Cited

U.S. PATENT DOCUMENTS

| | | | | |
|---|---|---|---|---|
| 2010/0328187 | A1* | 12/2010 | Husemann | H01Q 1/20 343/878 |
| 2011/0121924 | A1* | 5/2011 | White | H01P 5/028 333/260 |
| 2012/0068896 | A1* | 3/2012 | White | H01Q 1/1271 343/713 |
| 2012/0127050 | A1* | 5/2012 | Song | H01Q 1/1271 343/756 |
| 2014/0263655 | A1* | 9/2014 | Forster | H01Q 1/2225 235/488 |
| 2015/0071137 | A1* | 3/2015 | Thiam | H01Q 9/0407 370/297 |
| 2017/0054217 | A1* | 2/2017 | Hashimoto | H01Q 9/0457 |

OTHER PUBLICATIONS

Mehdipour A. et al. "Miniaturised Coplanar Waveguide-Fed Antenna and Band-Notched Design for Ultra-Wideband Applications" IET Microwaves, Antennas and Propagation, vol. 3, No. 6, Sep. 2009, pp. 974-986.

Zamel, Hany M. et al. "Design of a Compact UWB Planar Antenna with Band-Notch Characterization" Radio Science Conference, NRSC National, 2007, Mar. 13-15, 2007, pp. 1-8.

Lee, Jung N. "Impedance Characteristics of Trapezoidal Ultra-Wideband Antennas with a Notch Function" Microwave and Optical Technology Letters, vol. 46, Nol 5, Sep. 5, 2005, pp. 503-506.

* cited by examiner

WIDEBAND COPLANAR WAVEGUIDE FED MONOPOLE APPLIQUE ANTENNAS

CROSS-REFERENCE TO RELATED APPLICATIONS

This application claims the benefit of the priority date of U.S. Provisional Patent Application Ser. No. 62/295,822, titled, Wideband Coplanar Waveguide Fed Monopole Applique Antennas, filed Feb. 16, 2016.

BACKGROUND OF THE INVENTION

Field of the Invention

This invention relates generally to a thin, flexible, wideband antenna configured on a dielectric substrate and, more particularly, to a thin, flexible, wideband co-planar waveguide (CPW) antenna that may include transparent conductors so as to allow the antenna to be adhered to a visible part of vehicle windows.

Discussion of the Related Art

Modern vehicles employ various and many types of antennas to receive and transmit signals for different communications systems, such as terrestrial radio (AM/FM), cellular telephone, satellite radio, dedicated short range communications (DSRC), GPS, etc. Further, cellular telephone is expanding into 4G long term evolution (LTE) that requires two antennas to provide multiple-input multiple-output (MIMO) operation. The antennas used for these systems are often mounted to a roof of the vehicle so as to provide maximum reception capability. Further, many of these antennas are often integrated into a common structure and housing mounted to the roof of the vehicle, such as a "shark-fin" roof mounted antenna module. As the number of antennas on a vehicle increases, the size of the structures required to house all of the antennas in an efficient manner and providing maximum reception capability also increases, which interferes with the design and styling of the vehicle. Because of this, automotive engineers and designers are looking for other suitable areas on the vehicle to place antennas that may not interfere with vehicle design and structure.

One of those areas is the vehicle glass, such as the vehicle windshield, which has benefits because glass makes a good dielectric substrate for an antenna. For example, it is known in the art to print AM and FM antennas on the glass of a vehicle where the printed antennas are fabricated within the glass as a single piece. However, those known systems are generally limited in that they could only be placed in a vehicle windshield or other glass surface in areas where viewing through the glass is not necessary.

SUMMARY OF THE INVENTION

The present invention discloses and describes a thin, flexible antenna that has particular application to be mounted to a dielectric substrate on a vehicle, such as vehicle glass, where the antenna has a wideband antenna geometry for various communications systems, and where the conductive portion of the antenna can employ transparent conductors.

Additional features of the present invention will become apparent from the following description and appended claims, taken in conjunction with the accompanying drawings.

DETAILED DESCRIPTION OF THE EMBODIMENTS

The following discussion of the embodiments of the invention directed to a thin, flexible wideband antenna suitable to be adhered to a curved dielectric structure is merely exemplary in nature, and is in no way intended to limit the invention or its applications or uses. For example, the discussion herein talks about the antenna being applicable to be adhered to automotive glass. However, as will be appreciated by those skilled in the art, the antenna will have application for other dielectric structures other than automotive structures and other than transparent or translucent surfaces.

Figure 1:
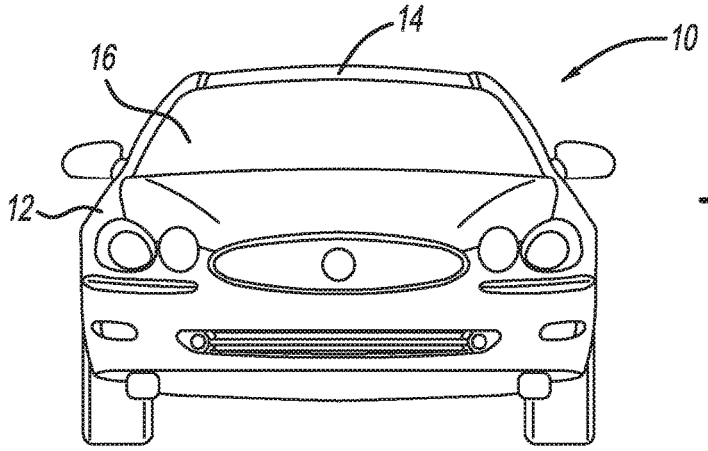
FIG. 1 is a front view of a vehicle showing a vehicle windshield.
Figure 2:
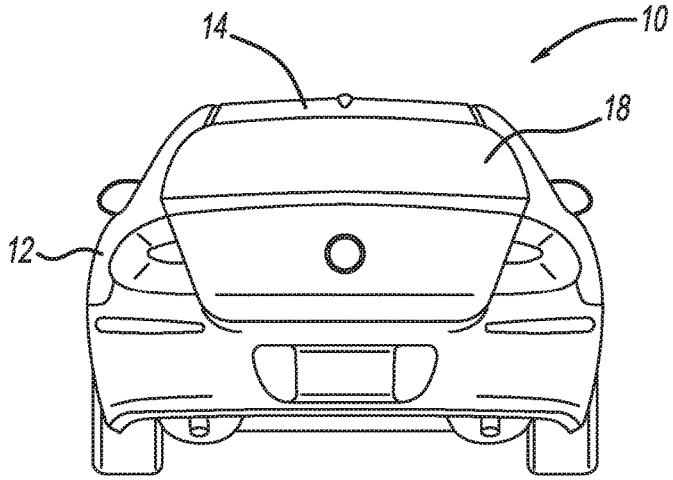
FIG. 2 is a rear view of the vehicle showing a vehicle rear window.

FIG. 1 is a front view of a vehicle 10 including a vehicle body 12, roof 14 and windshield 16, and FIG. 2 is a rear view of the vehicle 10 showing a rear window 18.

As will be discussed in detail below, the present invention proposes providing a wideband antenna on the windshield 16, the rear window 18, or any other window or dielectric structure on the vehicle 10, where the antenna is flexible to conform to the shape of the particular dielectric structure, and where the antenna can be mounted at any suitable location on the dielectric structure, including locations on the windshield 16 that the vehicle driver needs to see through. As will become apparent, the antenna provided on the dielectric structure may be operable for various communications systems, such as AM/FM radio antennas, DSRC antennas, satellite radio antennas, GPS antennas, cellular antennas, including MIMO antennas, etc. In one embodiment, the antenna is a wideband monopole appliqué antenna that is installed directly on the surface of the dielectric structure by a suitable adhesive. The disclosed antenna can be designed to operate on automotive glass of various physical thicknesses and dielectric properties, where the antenna only operates as intended when installed on the glass since the antenna geometry pattern on the carrier substrate will not have good impedance matching.

Figure 3:
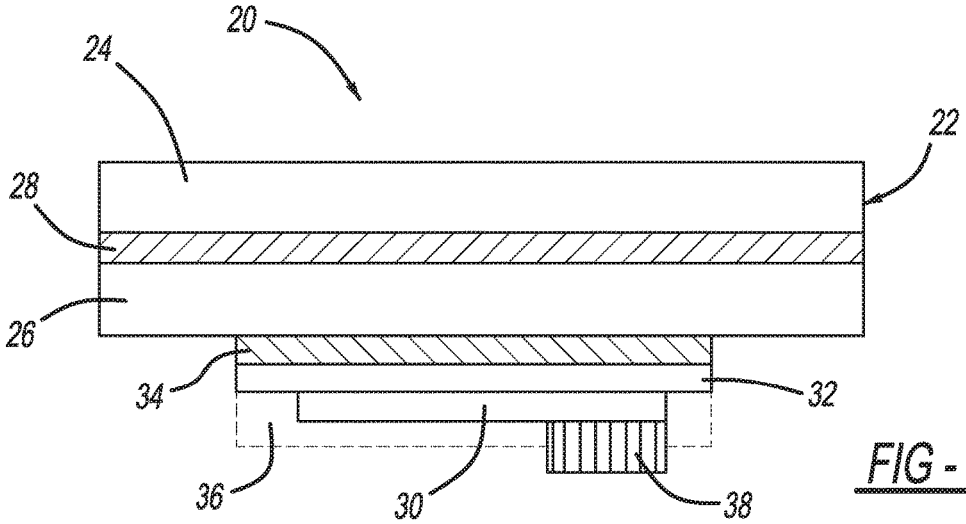
FIG. 3 is a profile view of a vehicle window including a thin, flexible antenna formed thereon.

FIG. 3 is a profile view of an antenna structure 20 including a windshield 22 having an outer glass layer 24, an inner glass layer 26 and a polyvinyl butyral (PVB) layer 28 therebetween. The structure 20 includes an antenna 30 formed on a thin, flexible film substrate 32, such as a mylar layer, and adhered to a surface of the layer 26 by an adhesive layer 34. The adhesive layer 34 can be any suitable adhesive or transfer tape that effectively allows the substrate 32 to be secured to the glass layer 26, and further, if the antenna 30 is located in a visible area of the glass layer 26, the adhesive or transfer tape can be transparent or near transparent so as to have a minimal impact on the appearance and light transmission therethrough. The antenna 30 can be protected by a low RF loss passivation layer 36, such as parylene. An antenna connector 38 is shown connected to the antenna 30 and can be any suitable RF or microwave connector such as a direct pig-tail or coaxial cable connection. Although the antenna 30 is shown being coupled to an inside surface of the inner glass layer 26, the conductor 30 can be adhered to the outer surface of the outer glass layer 24 or the surface of the layers 24 or 26 adjacent to the PVB layer 28 or the surfaces of the PVB layer 28.

The antenna 30 can be formed by any suitable non-lossy conductor, such as copper, gold, silver, silver ceramic, etc. If the antenna 30 is at a location on the vehicle glass that requires the driver or other vehicle occupant to see through the glass, then the antenna conductor can be any suitable transparent conductor, such as indium tin oxide (ITO), silver nano-wire, zinc oxide (ZnO), etc. Performance of the antenna 30 when it is made of a transparent conductor could be enhanced by adding a conductive frame along the edges of the antenna 30 as is known in the art.

The thickness of automotive glass may vary over 2.8 mm-5 mm and have a relative dielectric constant $\varepsilon_r$ in the range of 4.5-7.0. The antenna 30 includes a single layer conductor and a co-planar waveguide (CPW) feed structure to excite the antenna radiator. The CPW feed structure can be configured for mounting the connector 38 in a manner appropriate for the CPW feed line or for a pigtail or a coaxial cable. When the connector 38 or the pigtail connection to the CPW line is completed, the antenna 30 can be protected with the passivation layer 36. In one embodiment, when the antenna 30 is installed on the glass, a backing layer of the transfer tape can be removed. By providing the antenna conductor on the inside surface of the vehicle windshield 22, degradation of the antenna 30 can be reduced from environmental and weather conditions.

Figure 4:
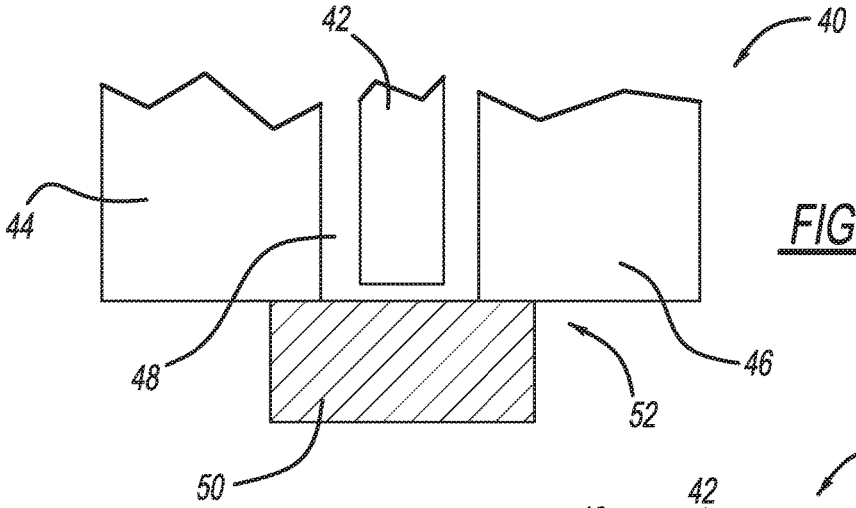
FIG. 4 is an illustration of a CPW antenna feed structure including opposing and coupled ground planes with a signal line therebetween.

FIG. 4 is a top, cut-away view of a CPW feed structure 40 including a signal line 42 that is coupled to the antenna radiator (not shown in FIG. 4) and that is spaced apart from opposing ground planes 44 and 46 defining a gap 48 therebetween. The ground planes 44 and 46 are electrically coupled by a conductor 50 at a connector region 52 to provide installation of a surface mount connector or direct mount pigtail or coaxial cable that connects the antenna to a suitable circuit, such as a transceiver (not shown), where the antenna, feed structure and connector are all in the same plane. The dimensions of the conductor 50 can be less than a quarter-wavelength at the center of the frequency band of interest.

Figure 5:
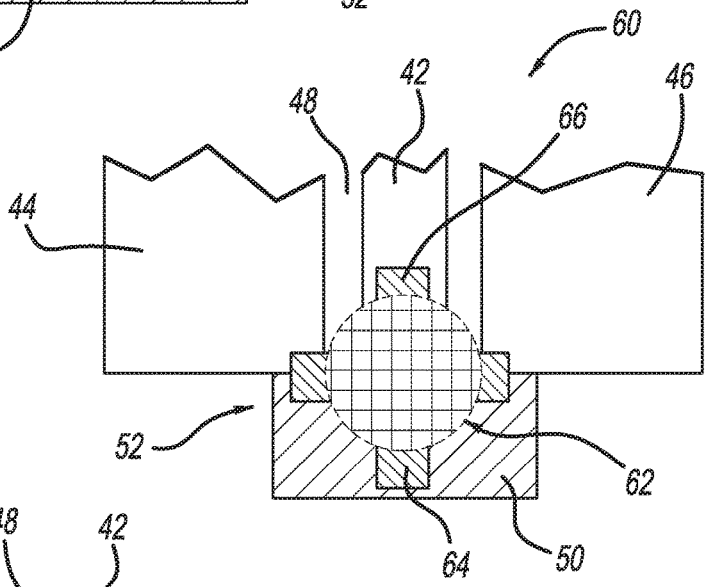
FIG. 5 is an illustration showing the CPW antenna feed structure and including an RF connector.

FIG. 5 is a top, cut-away view of a CPW antenna feed structure 60 similar to the antenna structure 40, where like elements are identified by the same reference number. In this embodiment, a surface mount connector 62 feeds the structure 60 and is electrically coupled to the ground planes 44 and 46 and the conductor 50 through tabs 64, which are electrically isolated from a tab 66 coupled to the signal line 42.

Figure 6:
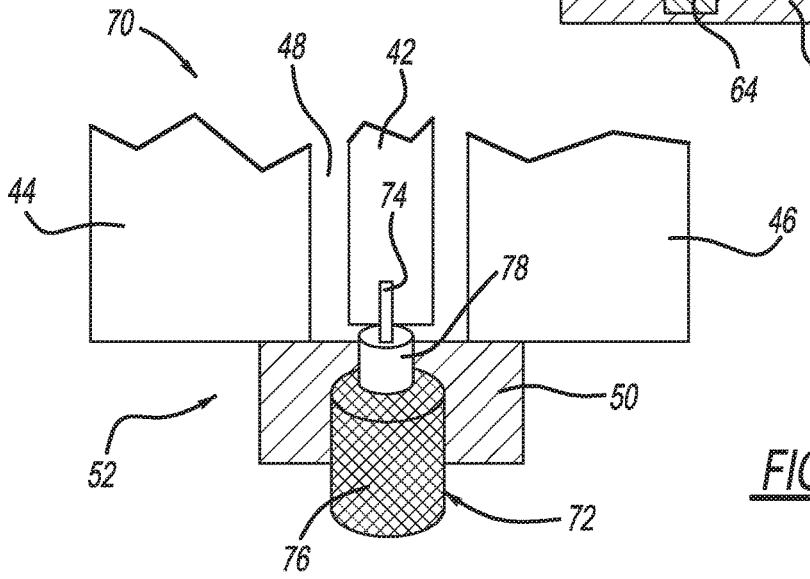
FIG. 6 is an illustration of the CPW antenna feed structure and including a coaxial cable feed line.

FIG. 6 is a top, cut-away view of a CPW antenna feed structure 70 similar to the antenna structure 40, where like elements are identified by the same reference number. In this embodiment, a coaxial cable 72 feeds the structure 70 and includes an inner conductor 74 electrically coupled to the signal line 42 and an outer ground conductor 76 electrically coupled to the conductor 50, where the conductors 74 and 76 are separated by an insulator 78.

Figure 7:
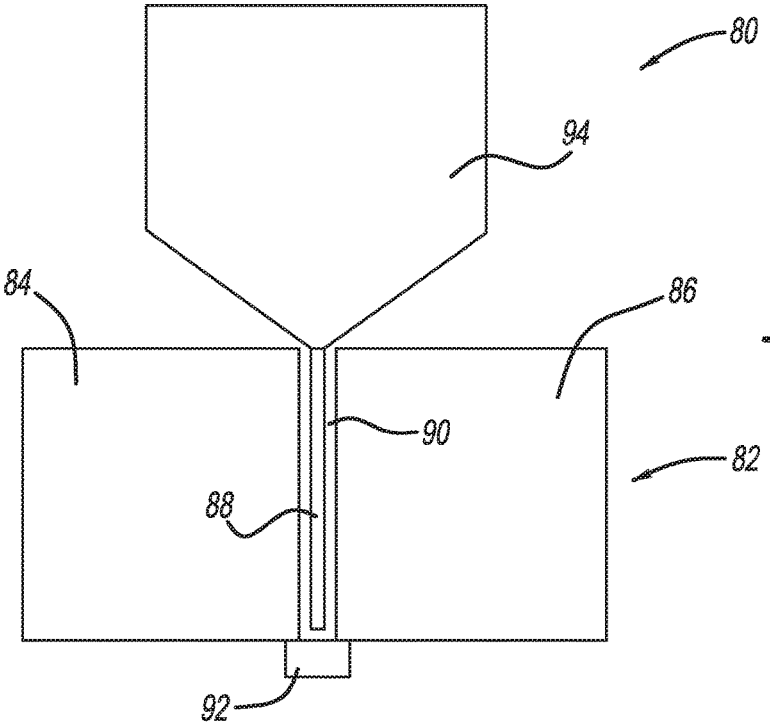
FIG. 7 is a top view of a wideband co-planar antenna including a radiator fed by a CPW feed structure.

FIG. 7 is a top view of a CPW antenna structure 80 including a feed structure 82 having opposing ground planes 84 and 86 and a signal line 88 extending therebetween that is electrically isolated from the planes 84 and 86 by a gap 90, where a conductor 92 is coupled to the ground planes 84 and 86. The feed line to the feed structure 82 is not shown. A specially configured radiator 94, here pentagon-shaped, fed by the feed structure 82 is electrically coupled to the signal line 88 at a tip of the radiator 94, as shown, where the radiator 94 flairs to a dimension that provides signal reception and transmission in the frequency band of interest, such as the 700 MHz-2.2 GHz frequency range suitable for LTE communications. For this embodiment, the overall length of the structure 80 is 13.5 cm and the width of the structure 80 is 12 cm.

Figure 8:
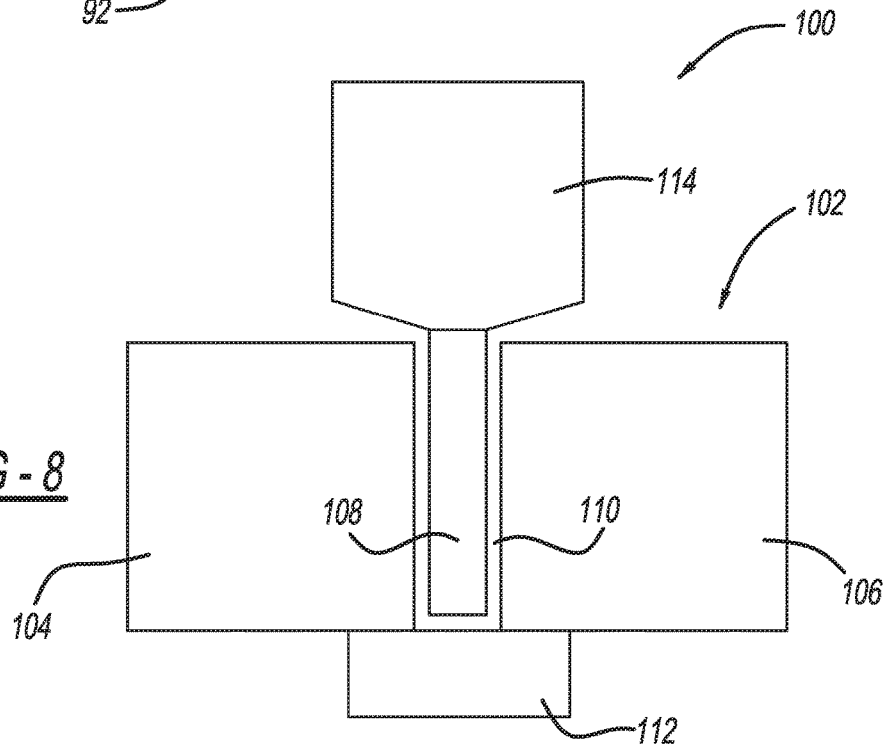
FIG. 8 is a top view of another wideband co-planar antenna including a radiator and a CPW feed structure.

FIG. 8 is a top view of a CPW antenna structure 100 similar to the antenna structure 80, but having different dimensions for DSRC communications operating at 5.9 GHz. The antenna structure 100 includes a feed structure 102 having opposing ground planes 104 and 106 and a signal line 108 extending therebetween that is electrically isolated from the planes 104 and 106 by a gap 110, where a conductor 112 is coupled to the ground planes 104 and 106. The feed line to the feed structure 102 is not shown. A specially configured radiator 114, here pentagon-shaped, fed by the feed structure 102 is electrically coupled to the signal line 108 at a tip of the radiator 114, as shown, where the radiator 114 flairs to a dimension that provides signal reception and transmission in the frequency band of interest.

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. An antenna structure comprising: a dielectric substrate;

a thin film substrate adhered to the dielectric structure by an adhesive layer;

a planar antenna conductor formed to the substrate opposite to the adhesive layer;

a feed structure positioned in the same plane as the antenna conductor and being electrically coupled thereto, wherein the feed structure is a co-planar waveguide (CPW) structure; and wherein the CPW structure includes opposing ground planes defining a gap therebetween, a signal line positioned within the gap and a feed conductor electrically coupling the ground planes at a connector region to provide for installation of at least one of a surface mount connector, a direct mount of a pigtail, and a coaxial cable, said antenna conductor being electrically coupled to the signal line; the feed structure including the conductor and the connector are all in the same plane.

2. The antenna structure according to claim 1 wherein the antenna conductor has a pentagon shape where a tip of the antenna conductor is coupled to the signal line.

3. The antenna structure according to claim 1 further comprising a connector, a pig-tail or a coaxial cable electrically coupled to the feed structure.

4. The antenna structure according to claim 1 wherein the dielectric structure is a vehicle window.

5. The antenna structure according to claim 4 wherein the vehicle window is a vehicle windshield.

6. The antenna structure according to claim 5 wherein the thin film substrate is secured to an outer surface of an outer glass layer, an inner surface of the outer glass layer, an outer surface of an inner glass layer, an inner surface of the inner glass layer, or a surface of a polyvinyl butyral (PVB) layer.

7. The antenna structure according to claim 1 wherein the antenna conductor is a transparent conductor.

8. The antenna structure according to claim 1 wherein the thin film substrate is a mylar substrate.

9. The antenna structure according to claim 1 wherein the adhesive layer is a transfer tape.

10. The antenna structure according to claim 1 wherein the adhesive layer is transparent.

11. The antenna structure according to claim 1 further comprising a passivation layer provided over the antenna conductor.

12. The antenna structure according to claim 1 wherein the antenna structure operates in a frequency band for a dedicated short range communications (DSRC) system, a GPS system, or a long term evolution (LTE) cellular system.

13. An antenna structure comprising: a vehicle window;

a thin film substrate adhered to the vehicle window by an adhesive layer;

a transparent planar antenna conductor formed to the substrate opposite to the adhesive layer; and a co-planar waveguide (CPW) feed structure positioned in the same plane as the antenna conductor and being electrically coupled thereto, wherein the CPW feed structure includes opposing ground planes defining a gap therebetween, a signal line positioned within the gap and a feed conductor electrically coupling the ground planes at a connector region to provide for installation of at least one of a surface mount connector, a direct mount of a pigtail, and a coaxial cable, said antenna conductor being electrically coupled to the signal line, said antenna conductor being electrically coupled to the signal line; the feed structure including the conductor and the connector are all in the same plane.

14. The antenna structure according to claim 13 wherein the antenna conductor has a pentagon shape where a tip of the antenna conductor is coupled to the signal line.

15. The antenna structure according to claim 13 wherein the vehicle window is a vehicle windshield, and wherein the thin film substrate is secured to an outer surface of an outer glass layer, an inner surface of the outer glass layer, an outer surface of an inner glass layer, an inner surface of the inner glass layer, or a surface of a polyvinyl butyral (PVB) layer.

16. An antenna structure configured to operate in a frequency band for a dedicated short range communications (DSRC) system, a GPS system, or a long term evolution (LTE) cellular system, said antenna structure comprising:

a vehicle windshield;

a thin film substrate adhered to the vehicle windshield by an adhesive layer, wherein the thin film substrate is secured to an outer surface of an outer glass layer, an inner surface of the outer glass layer, an outer surface of an inner glass layer, an inner surface of the inner glass layer, or a surface of a polyvinyl butyral (PVB) layer;

a transparent planar antenna conductor formed to the substrate opposite to the adhesive layer; and a co-planar waveguide (CPW) feed structure positioned in the same plane as the antenna conductor and being electrically coupled thereto, wherein the CPW feed structure includes opposing ground planes defining a gap therebetween, a signal line positioned within the gap and a feed conductor electrically coupling the ground planes at a connector region to provide for installation of at least one of a surface mount connector, a direct mount of a pigtail, and a coaxial cable, said antenna conductor being electrically coupled to the signal line, said antenna conductor being electrically coupled to the signal line, the feed structure including the conductor and the connector are all in the same plane.

17. The antenna structure according to claim 16 wherein the antenna conductor has a pentagon shape where a tip of the antenna conductor is coupled to the signal line.

* * * * *